United States Patent [19]

Lang et al.

[11] Patent Number: 4,760,690

[45] Date of Patent: Aug. 2, 1988

[54] PROCESS FOR THE PRODUCTION OF A WEFT FIBER OF POLYESTER-POY

[75] Inventors: Bruno Lang, Ballwil; Paul Schaffner, Kriens, both of Switzerland

[73] Assignee: Viscosuisse SA, Emmenbruecke, Switzerland

[21] Appl. No.: 936,648

[22] Filed: Nov. 20, 1986

[30] Foreign Application Priority Data

Nov. 20, 1985 [CH] Switzerland ..... 04 944/85

[51] Int. Cl.[4] ..... D02G 3/48; D02G 3/00

[52] U.S. Cl. ..... 57/243; 57/282; 57/902

[58] Field of Search ..... 57/200, 243, 282, 290, 57/309, 902, 287, 288; 428/369, 373

[56] References Cited

U.S. PATENT DOCUMENTS

| | | | |
|---|---|---|---|
| 3,093,955 | 6/1963 | Cadario | 57/282 |
| 3,665,994 | 5/1972 | Kovac et al. | 57/902 X |
| 4,357,385 | 11/1982 | Kuroda et al. | 57/902 X |
| 4,563,392 | 1/1986 | Harpell et al. | 428/373 X |

*Primary Examiner*—Donald Watkins

*Attorney, Agent, or Firm*—Michael J. Striker

[57] ABSTRACT

A process is disclosed for production of a heat-treated, coarse fiber of polyester-POY, whereby the fiber is first twisted and then continuously relaxed and tempered at a temperature from 130° to 250° C. to an extent from 20 to 55%. The slide-resistant fiber produced in this manner, displaying an elongation at break from 150 to 350%, a thermal shrink from +6 to −6% can be employed without further pre-treatment as weft yarn for tire cord webs.

10 Claims, No Drawings

PROCESS FOR THE PRODUCTION OF A WEFT FIBER OF POLYESTER-POY

BACKGROUND OF THE INVENTION

The invention concerns a process for the production of a heat-treated, coarse fiber of polyester-POY, preferably in the form of a weft yarn for a tire cord fabric as well as a polyester fiber produced according to this process.

Serving as starting material for the process according to the invention is a polyester-POY, manufactured on the basis of an at least 90% polyethylene terephthalate, having a titer of 50–300 dtex and 20–50 fibrels.

Automobile tires of known structural type are composed in their essential parts of a stress carrier in the form of cords of synthetic yarns, which are embedded, in the form of a cord web, into rubber. The exterior appearance and, in particular, the running surface, are determined by the rubber.

In order for such tires with a cord web of synthetic filaments to have good running characteristics and a long useful lifetime, two essential conditions, among others, must be fulfilled: the tires must be very uniform in their shape, and their dimensional stability must remain as great as possible during use, even at increased velocity. It is a prerequisite for this that the cord fiber framework be spread and distributed as uniformly as possible during tire manufacture. In particular, the weft fiber per se must not therewith oppose disturbing resistance. In order to attain this condition, processes are known in which the carcass cords are parallelly arranged and calendared directly into the rubber, or where the web weft is intersected between the cord chain fibers before the calendaring. However, both processes are not easy to control insofar as reliability is concerned.

Other techniques are known, whereby the tire cord web is manufactured with slightly elastic weft.

Such weft yarns are composed either of polyester or nylon POY-filament yarns, which attain very high elongation values through extensive outshrinking. The initial strength required for working-up, as well as sufficient sliding strength and heat resistance can be attained by means of supplementary twisting around of cotton staple yarn. It is a peremptory disadvantage of this yarn, however, that it displays fluctuating initial strength, on account of the never entirely uniform twisting around of cotton along its fibers, which then later manifests itself negatively through a uniform spreading of framework cord in the tires.

Other tire cord webs are known, in which the weft fibers are composed of POY-polyester filaments, and which for fixing or for reduction of the shrinkage, are subjected to an additional heat treatment under determined tension on appropriate yarn carriers, and for prevention of slippage between the chain fibers are pre-treated with a rubber latex or are twisted around with cotton fibers (DE-A-27 48 747). The relaxation corresponds only to the portion possible by means of the winding. With the known weft yarns, the friction stability is effected by means of a latex mantle. The breaking elongation is determined to be from 80 to 250%.

The known processes display several disadvantages. The heat treatment is performed in conjunction with a determined fiber traction, in order to avoid excessive shrinkage. The forces resulting therewith differentially load the fiber inside the winding in its most sensitive circumstance, the result of which can be differences in shrink and tension.

With high temperature impregnation webs (i.e. approx. 240° C.) using the known weft yarns of less than 100% residual breaking elongation, the wefts in the web frequently tear when the tire blank (unfinished tire) is brought into its required shape by means of expansion.

A further disadvantage is the employment of a rubber latex for prevention of slipping of the weft fibers along the longitudinal side of the chain fibers, whereby an additional process step is necessary, which disadvantageously influences the economy of the process.

Finally, it is a considerable disadvantage that the employment of latex produces latex powder (dust) during the weaving. The powder is composed of electrically charged rubber particles which are removable only with difficulty and expense, and which can lead to operational faults of the web.

SUMMARY OF THE INVENTION

It is therefore the object according to the present invention to provide a process for the production of a polyester fiber which displays a coarse, non-slip surface, a secant modulus from 0 to 50%, an initial modulus greater than 4 cN/dtex, high breaking elongation, weak shrinkage and good adhesion, without use of adhesion-promoting rubber latex. When employed as weft fibers, such polyester fibers should in particular, sufficiently withstand the high thermal and mechanical loading during impregnation, calendaring and later working-up into automobile tires.

This object is attained according to the present invention by twisting the weft fiber in a first process step with 40 to 200 tpm and then, in a second process step, continuously relaxing and tempering the twisted fiber during a period from 0.1 to 60 seconds, at a temperature from 130° to 250° C., to an extent from 20 to 55%.

A fiber twisted with 40 to 200 turns per meter possesses the advantageous characteristic of roughness, which previously could be obtained only with a latex treatment. The fibers twisted in this manner are tempered, in practice, only with process-required initial stressing force during 0.1 to 60 seconds, in particular during 0.1 to 30 seconds, preferably during about 0.2 seconds, in a vertical or horizontal heating section at a temperature greater than 130° C., in particular from 130° to 250° C., but preferably at about 230° C. The brief tempering period possesses the advantage that at relatively high temperatures, optimal characteristics of the weft fibers are obtained, without the known disadvantages.

It is expedient to employ a POY-yarn as weft fiber. A shock-like temperature treatment is particularly advantageous, since thereby results a minimal injury to the fibers and the best fibrels bundle, with a non-slip surface, are obtained. In case of need, one can additionally follow with a rubber-compatible treatment, for example, based upon epoxide or isocyanate.

By means of either a tension-free thermal treatment, or a thermal treatment performed with controlled advance of the fiber, a desired relaxation is obtained, whereby the fiber contains a texturized structure.

It is expedient to undertake the thermal treatment with the aid of a convection of contact heater. In addition, it is possible to increase the degree of fixing by means of additional thermal after-treatments.

The breaking elongation of the weft fiber lies between 150 and 350%. In general, particularly good results are obtained with an elongation at break of about 300%. This range has proven to be expedient with extreme loading, even possibly upon web hot stretching at temperatures above 240° C.

In connection with the above-disclosed elongation at break, a thermal shrinkage from +6 to −6%, at 160° C. temperature and 0.025 cN/tex fiber traction, a secant modulus particularly from 0 to 50%, a reversibility limit from 0.2 to 0.6 cN/dtex and an initial modulus from 4 to 10 cN/dtex are most expedient.

Secant modulus is the designation for a measured variable of the fiber independent of titer. The secant modulus is defined as the slope of a segment within the stress-strain curve in the flow range of a fiber limited between 10+30% elongation. The extension of the slope line up to theoretical 100% elongation and parallel displacement of the resulting lines through the null point of the coordinate system leads to a theoretical force with 100% theoretical elongation. The secant modulus defines this point as a percent portion of the effective breaking force (WO 84/02357).

The reversibility limit designates the transition from reversible into the irreversible elongation range.

The tensile strength of the fiber lies within the range from 0.6 to 2 cN/dtex, and satisfies the requirements of framework webs worked up under customary tire production conditions.

By means of the fibrels with irregular sinuosities slight curling is caused, which contributes to a latex-free warp fiber fixation in the tire body web.

A distortion-free weft fiber possesses the advantage that no operational difficulties occur upon copping and interweaving. It is advantageous to provide, in addition to the before-mentioned twisting of the material, an intermingling, or alternatively a strong intermingling only. The number of intermingling points, or the number of knots per meter, are to be limited therewith to between 10 and 120, in order to obtain the correct, compact fibrels bundle, which holds the reception of dips during impregnation within the correct limits.

The novel features which are considered characteristic for the invention are set forth in particular in the appended claims. The invention itself, however, both as to its constructtion and its method of operation, together with additional objects and advantages thereof, will be best understood from the following description of specific embodiments.

DESCRIPTION OF THE PREFERRED EMBODIMENTS

EXAMPLE

A POY-polyester dtex 190 f 36 produced with a spinning velocity of greater than 3000 m/min is twisted to 100 turns per meter and subsequently led through a convection dryer heated to 230° C., with 100% leading of phase with regard to forward winding. Instead of a convection dryer, a contact dryer is also suitable.

The yarn resulting therefrom has a titer of about 385 dtex. Its initial modulus amounts to 6.25 cN/dtex; its reversibility limit lies at 0.4 cN/dtex and its elongation at break is 285%.

The parameters of the fiber produced according to the present invention are summarized in the following Table:

TABLE

CHARACTERISTICS OF FIBERS PRODUCED ACCORDING TO THE PRESENT INVENTION

| | Starting Material | After Additional Thermal Treatment: rough 60 s 240° C. | dipped 60 s 240° C. | dipped 30 s 240° C. |
|---|---|---|---|---|
| Titer dtex | 385 | 385 | | |
| Tensile Strength N | 3.9 | 2.9 | 2.7 | 3.6 |
| Residual Tensile Str. % | | 74.4 | 69.2 | 92.3 |
| Breaking Elongation % | 285 | 156 | 132 | 209 |
| Residual Elongation % | | 54.7 | 46.3 | 73.3 |
| Strength cN/tex | 10.1 | 7.5 | | |
| Reversibility Limit N | 1.6 | 1.9 | 2.2 | 2.2 |
| Secant Modulus % | 1.8 | | | |
| Thermal Shrink at 160° C., 15 min. % | 0.1 | | | |

It will be understood that each of the elements described above, or two or more together, may also find a useful application in other types of fiber productions differing from the types described above.

While the invention has been illustrated and described as embodied in a process for the production of a weft fiber of polyester-POY, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, rairly constitute essential characteristics of the generic or specific aspects of this invention.

What is claimed as new and desired to be protected by Letters Patent is set forth in the appended claims.

1. Process for the production of a multifilament weft yarn of polyester-POY with at least 90% polyethylene terephthalate, with a coarse non-sliding surface for a tire cord web, comprising twisting the yarn with 40 to 200 tpm, and continuously relaxing and tempering the twisted yarn over a period of 0.1 to 30 seconds, at a dry heat temperature between 180° and 250° C., to an extent from 20 to 55%.

2. The process according to claim 1, wherein thermal treatment is performed with a tension resulting from the feed of the said yarn.

3. The process according to claim 1, wherein thermal treatment is performed with controlled advance of said yarn.

4. The process according to claim 1, wherein thermal treatment in said second step is performed by means of a convection heater.

5. The process according to claim 1, wherein thermal treatment in said second step is performed by means of a contact heater.

6. Fiber produced according to the process of claim 1, characterized in that said fiber simultaneously satisfies the following conditions: the surface of said fiber is coarse and non-slip; said fiber displays a breaking elongation from 150 to 350%; a thermal shrink from +6 to −6%; a secant modulus from 0 to 50%; a reversibility limit from 0.2 to 0.6 cN/dtex and an initial modulus from 4 to 10 cN/dtex.

7. The fiber according to claim 6, further characterized by a tensile strength from 0.6 to 3 cN/dtex.

8. The fiber according to claim 6, further characterized by fibrels with irregular sinuosities.

9. The fiber according to claim 6, further characterized by being distortion-free.

10. The fiber according to claim 6, further characterized by a compact fibrels bundle with 100 to 500 tpm and/or an intermingling of 10 to 100 intermingling points per meter.

* * * * *